US007841677B2

(12) United States Patent
Hsieh

(10) Patent No.: US 7,841,677 B2
(45) Date of Patent: Nov. 30, 2010

(54) PIVOTABLE TOOL BOX

(75) Inventor: Chih-Ching Hsieh, No. 367, Pei Yang Road, Feng Yuan, Taichung County (TW)

(73) Assignee: Chih-Ching Hsieh, Taichung County (TW)

( * ) Notice: Subject to any disclaimer, the term of this patent is extended or adjusted under 35 U.S.C. 154(b) by 0 days.

(21) Appl. No.: 12/814,509

(22) Filed: Jun. 14, 2010

(65) Prior Publication Data

US 2010/0243497 A1 Sep. 30, 2010

Related U.S. Application Data

(62) Division of application No. 11/806,698, filed on Jun. 4, 2007, now Pat. No. 7,766,435.

(51) Int. Cl.
*A47B 46/00* (2006.01)

(52) U.S. Cl. ..... 312/249.11; 312/319.7

(58) Field of Classification Search ..... 312/249.8, 312/249.11, 349.1, 319.7; 74/423; 474/61, 474/84, 86, 148, 150, 62
See application file for complete search history.

(56) References Cited

U.S. PATENT DOCUMENTS 3,598,194 A * 8/1971 Wappler et al. ..... 474/86
3,738,257 A * 6/1973 Manfre et al. ..... 99/547
3,913,410 A * 10/1975 Ackerman ..... 474/56
4,846,768 A * 7/1989 Kitami et al. ..... 474/86
5,217,090 A * 6/1993 Billington et al. ..... 182/141
5,794,547 A * 8/1998 Dallman et al. ..... 109/50
5,830,094 A * 11/1998 DeNijs ..... 474/73
5,913,582 A * 6/1999 Coonan ..... 312/249.11
6,000,770 A * 12/1999 Frich ..... 312/319.7
6,267,701 B1 * 7/2001 Mott ..... 474/164
6,443,543 B1 * 9/2002 Chiang ..... 312/319.7
2003/0201699 A1 * 10/2003 Hong et al. ..... 312/249.11
2006/0201300 A1 * 9/2006 Schwaiger et al. ..... 83/473

FOREIGN PATENT DOCUMENTS

EP 507343 * 10/1992 ..... 312/249.11

* cited by examiner

*Primary Examiner*—Hanh V Tran
(74) *Attorney, Agent, or Firm*—CKC & Partners Ltd.

(57) ABSTRACT

A tool box includes a body with drawers and the body is rotatably connected to a base. A brake unit is received in the base and includes a first board fixed to the base and a second board movably located on the first board by connection plates pivotably connected between the first and second boards. A brake disk is rotatably located on the first board and the shaft is securely connected to the brake disk so that the brake disk is co-rotated with the body. The second board is controlled to move and contact the brake disk on the first board by a clutch pedal. When the second board contacts the brake disk, the body together with the base is moved as one piece, and when the second board is disengaged from the brake disk, the body can be rotated independently relative to the base.

4 Claims, 9 Drawing Sheets

PIVOTABLE TOOL BOX

RELATED APPLICATIONS

The present application is a divisional of the application Ser. No. 11/806,698, filed Jun. 4, 2007, the entire contents of which are hereby incorporated herein by reference.

BACKGROUND

1. Technical Field

The present invention relates to a tool box with a pivotable device which allows the tool box to be pivoted to a desired angular position.

2. Description Of Related Art

A conventional tool box is shown in FIG. 8, and generally includes a base 914 with recesses defined therein and a cover 914 is pivotably connected to the base 914. A first plate is received in the base and includes recesses to receive tools, and a second plate 91 is pivotably received in the cover 914 and also include recesses for storage of tools. The second plate 91 includes two pivots 911 extending from a top and bottom and the two pivots 911 are engaged with slots 913 defined in an inner wall 912 of the cover 914. The second plate 91 can be pivoted about the pivots 911 to an angular position for convenience of the user to pick up tools from the second plate 91.

Another conventional tool box 92 is disclosed in FIGS. 9 and 10 and generally includes bucket like body and a base 923 which is composed of a first part 922 and a second part is overlapped on the first part 922 by a pin. The bucket like body is composed of two halves 926, 927 and each half 926/927 includes a groove 924 defined in an inner periphery thereof and the second part of the base 923 includes a flange 921 which is movably received in the grove 924 so that the bucket like body is rotatable about the base 923. The two halves 926, 927 each have recesses defined in an outer periphery thereof so as to receive tools therein and the user simply rotates the bucket like body to move the desired tool in front of the user.

The present invention intends to provide a tool box that includes a body with drawers and the body is rotatable relative to a base, a brake unit is located between the body and the base so that the user can hold the orientation of the body or can allow the body to rotate to a desired position.

SUMMARY

The present invention relates to a tool box that comprises a body and a shaft has a first end rotatably connected to a base and a second end of the shaft is connected to an underside of the body. A brake unit is received in the base and includes a first board fixed to the base and a second board movably located on the first board by connection plates pivotably connected between the first and second boards. A brake disk is rotatably located on the first board and the shaft is securely connected to the brake disk which is co-rotated with the body. The second board is controlled to move and contact the brake disk on the first board by a clutch pedal.

The present invention will become more obvious from the following description when taken in connection with the accompanying drawings which show, for purposes of illustration only, a preferred embodiment in accordance with the present invention.

DETAILED DESCRIPTION

Figure 1:
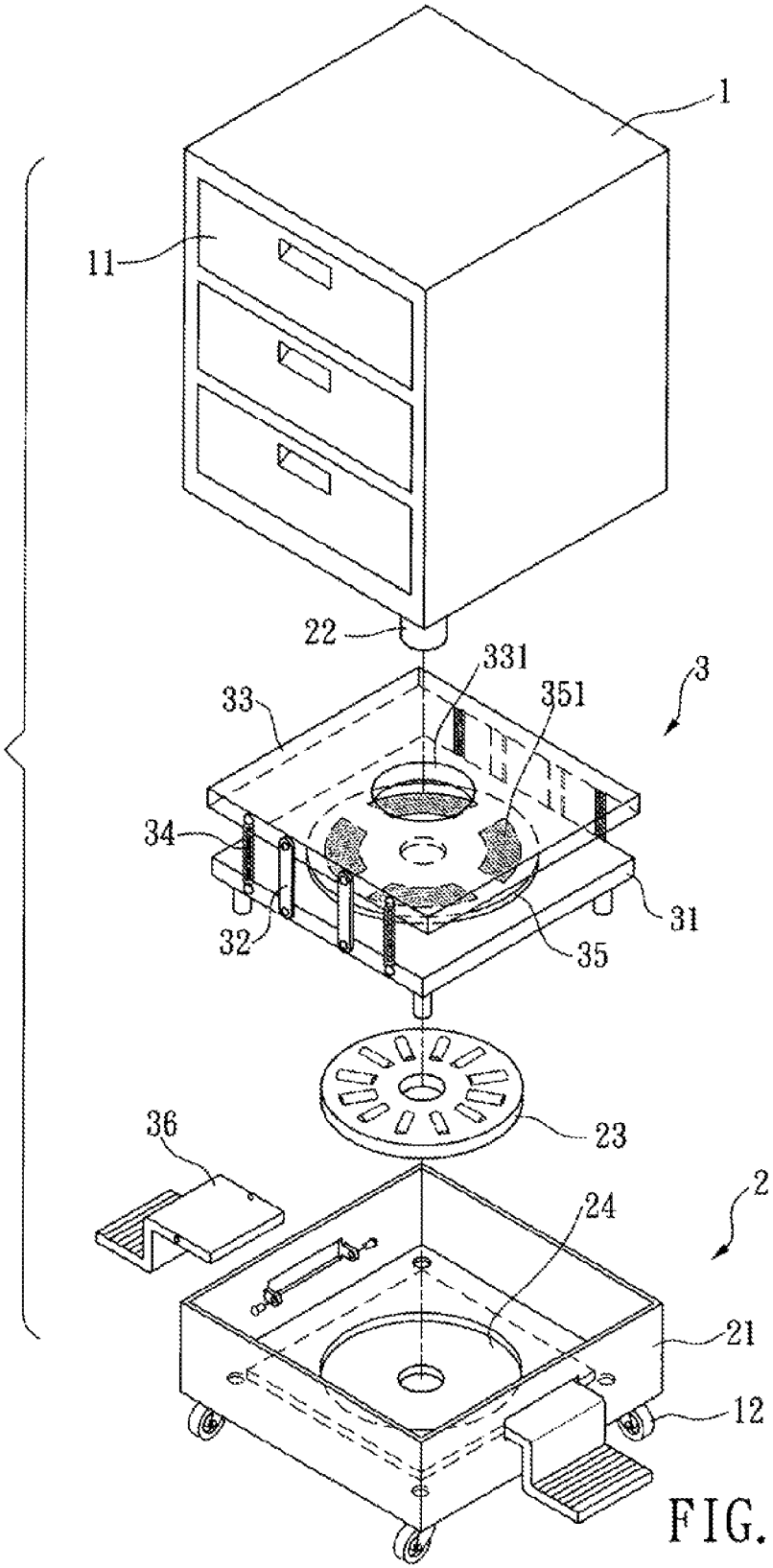
FIG. 1 is an exploded view to show the first embodiment of the tool box of the present invention.
Figure 2:
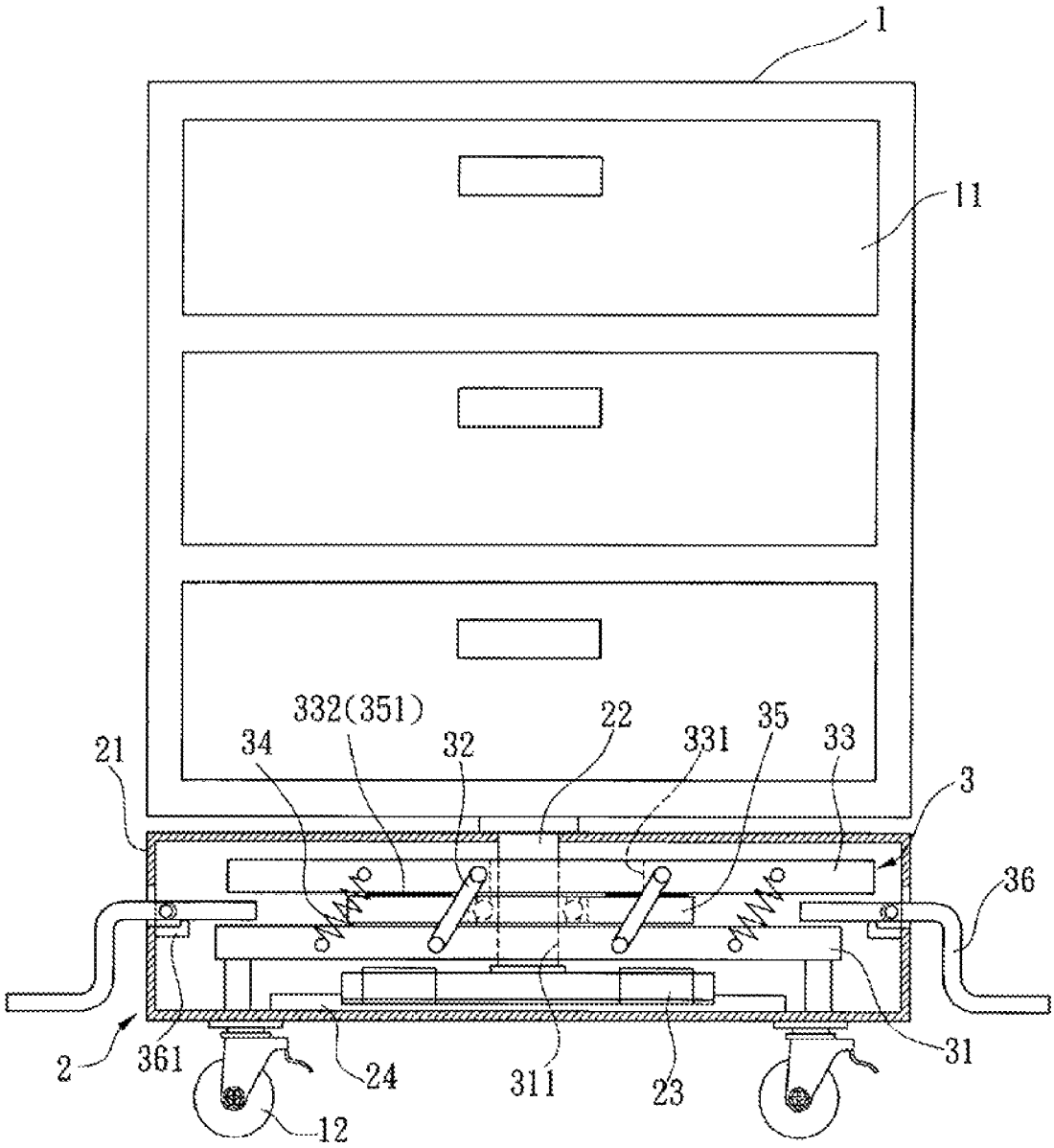
FIG. 2 is a side view to show the tool box in FIG. 1 wherein the clutch pedals are not yet operated.

Referring to FIGS. 1 and 2, the first embodiment of the tool box of the present invention comprises a body 1 with three drawers 11 which is slidably received in the body 1.

A base 2 has a sidewall 21 extending from a top thereof and a recess 24 is defined in an inside of the base 2 so as to receive a bearing 23 therein. Four casters 12 are connected to an underside of the base 2. A shaft 22 has a first end rotatably connected to the bearing 23 in the base 2 and a second end of the shaft 22 is connected to an underside of the body 1.

A brake unit 3 is received in the base 2 and includes a first board 31 fixed to the base 2 and a second board 33 is movably located on the first board 31 by connection plates 32 pivotably connected between the first and second boards 31, 33. A brake disk 35 is rotatably located on the first board 31 and the shaft 22 is securely connected to the brake disk 35 which is co-rotated with the body 1. The first board 31 includes a shaft hole 311 and the second board 33 includes a through hole 331, the second end of the shaft 22 extends through the through hole 331, the brake disk 35 and is rotatably engaged with the shaft hole 311. An inner diameter of the through hole 331 is larger than an outer diameter of the shaft 22 so that when the second board 33 does not affect the shaft 22 when the second board 33 is controlled to move up and down relative to the first board. The second board 33 includes first brake shoes 332 and the brake disk 35 includes second brake shoes 351 which are in contact with the first brake shoes 332 when the second board 33 is in contact with the brake disk 35. A plurality of springs 34 are connected between the first and second boards 31, 33 so as to normally pull the second board 33 to contact with the brake disk 35. In other words, the body 1 cannot rotate because of the contact of the first and second brake shoes 332, 351. Therefore, the body 1 and the base 2 are moved as a conventional tool box.

Figure 3:
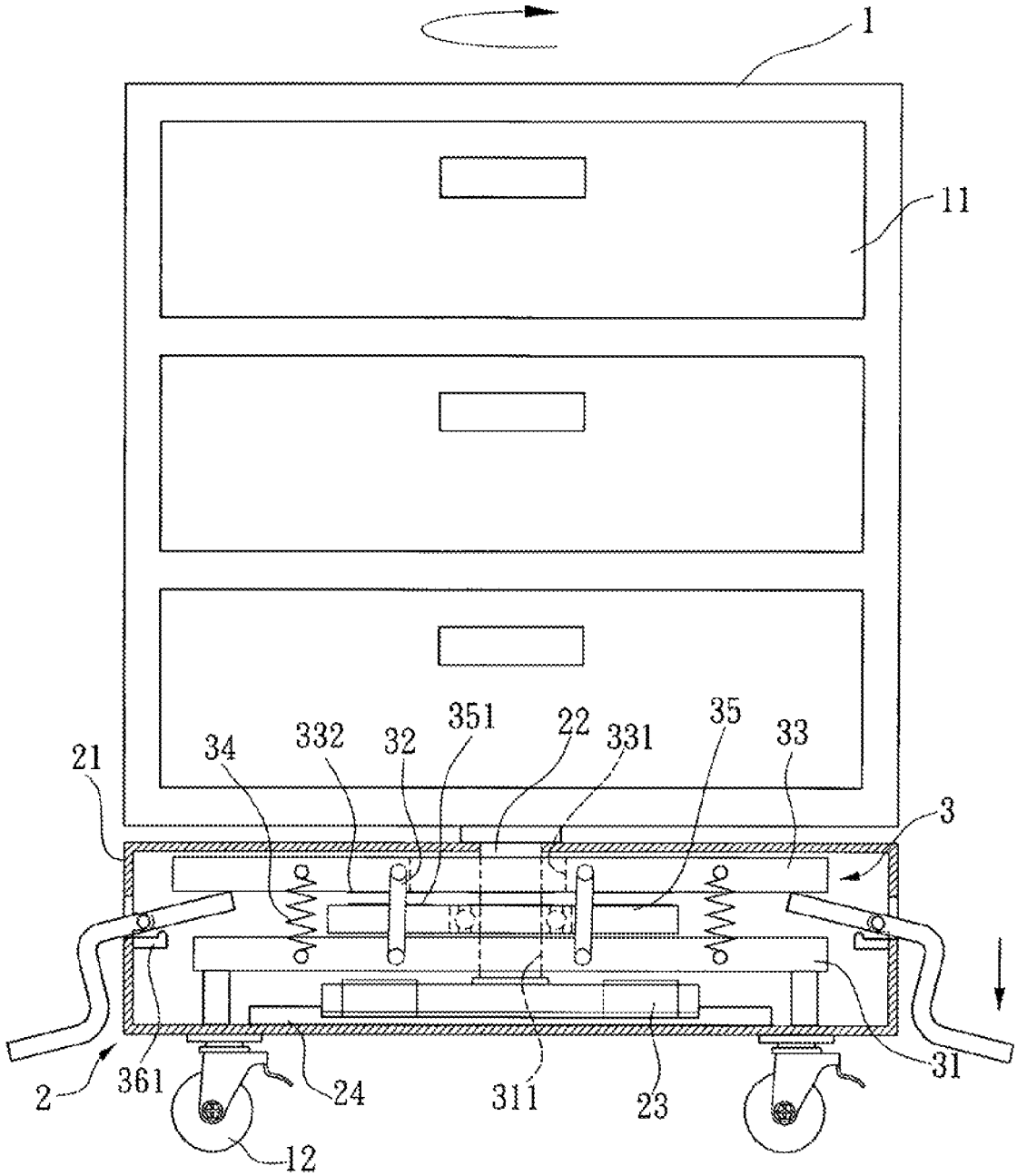
FIG. 3 is a side view to show the tool box in FIG. 1 wherein the clutch pedals are operated to disengage the first and second brake shoes.
Figure 4:
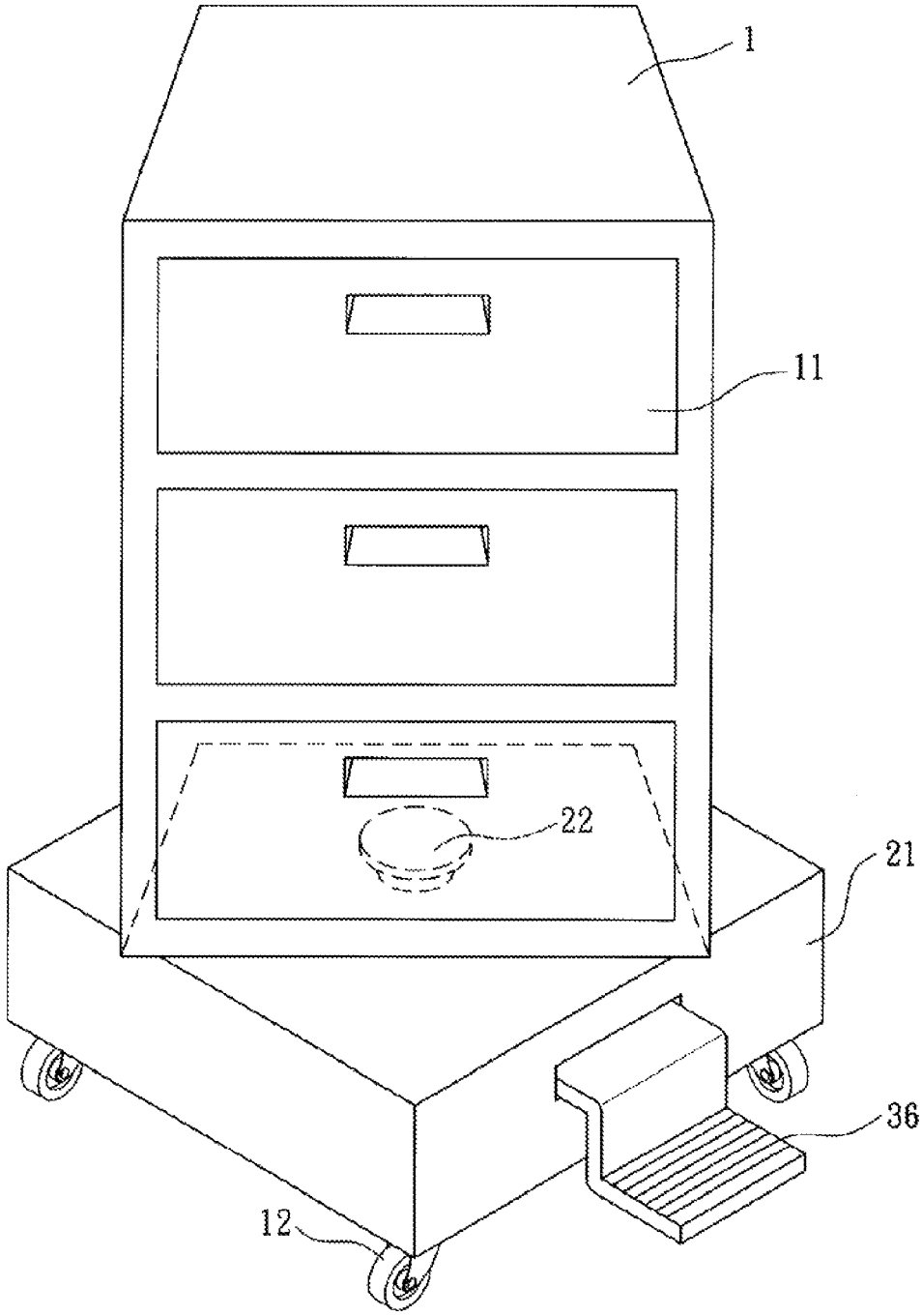
FIG. 4 show that the body is rotated relative to the base.

Two clutch pedal 36 are connected to two opposite sides of the sidewall 21 of the base 2 and each have a first end pivotably inserted through the sidewall 21 of the base 2 and a second end of the clutch pedal 36 is located outside of the sidewall 21 of the base 2. As shown in FIGS. 3 and 4, the first end of each clutch pedal 36 is located beneath the second board 33 so that when the second end of each of the clutch pedals 36 is pivoted downward, the first end of the clutch pedal 36 pushes the second board 33 to remove the second board 33 from the brake disk 35. The first and second brake shoes 332, 351 are separated and the body 1 can be rotated relative to the base 2. Two supports 361 are connected to an inside of the sidewall 21 and support the two respective first ends of the clutch pedals 36 such that the first ends of the clutch pedals 36 is well positioned. Therefore, the user can step downward the clutch pedals 36 to separate the first and second brake shoes 332, 351, and then rotate the body 1 to a desired direction to pull the drawers 11 while the base 2 is remained stationary.

Figure 5:
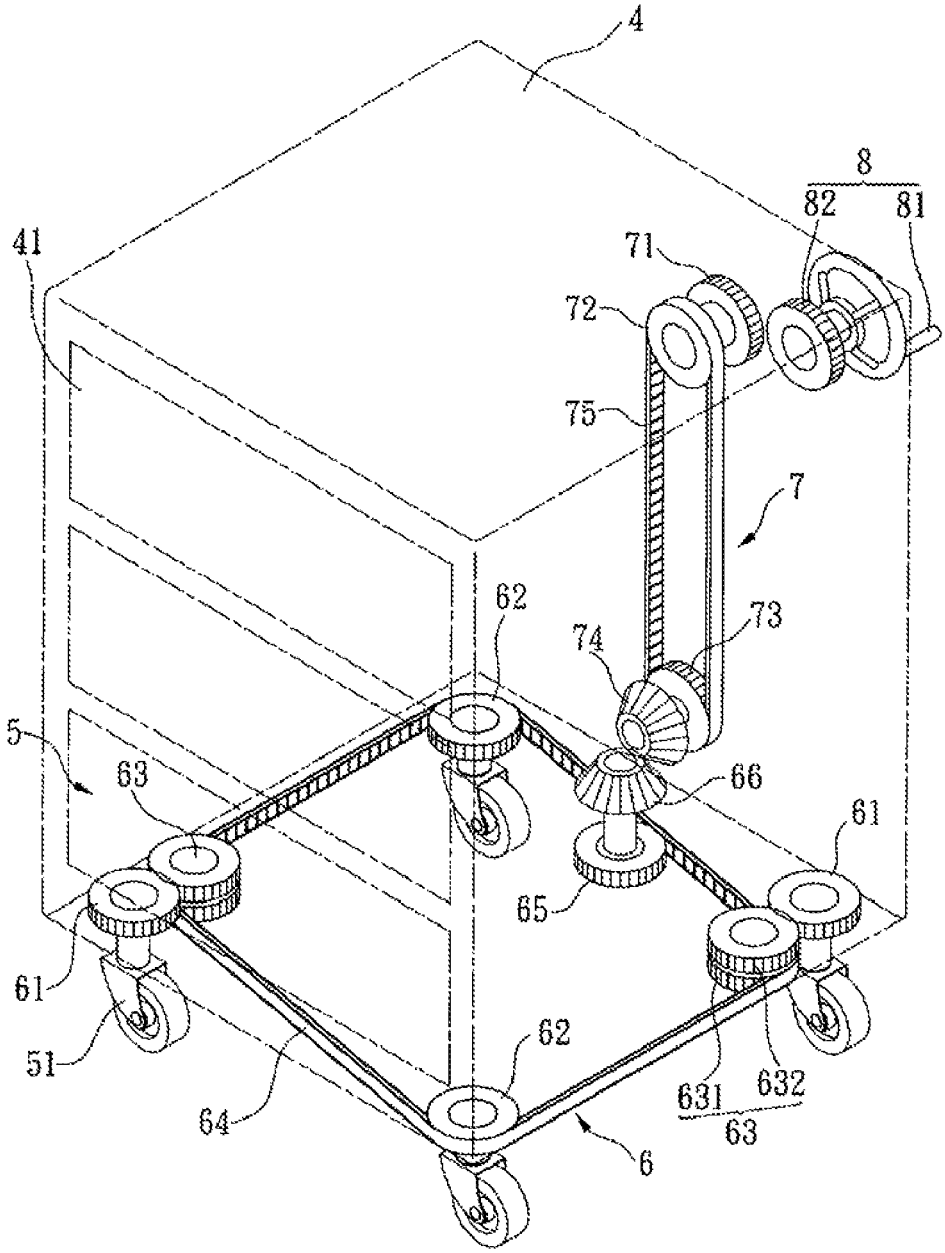
FIG. 5 is a perspective view to show a second embodiment of the tool box of the present invention.
Figure 6:
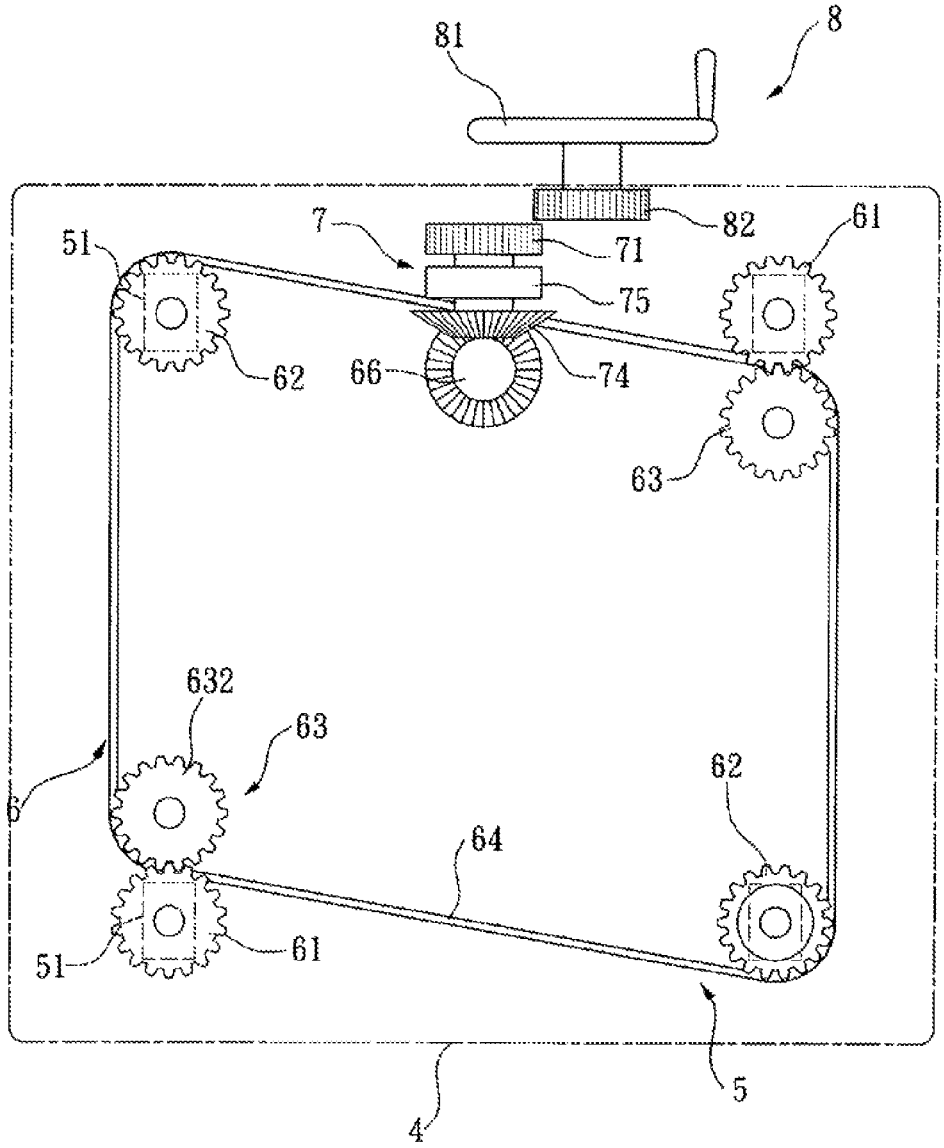
FIG. 6 is a top view to show the operation system, the turning unit, the transmission unit and the operation device of the tool box in FIG. 5.
Figure 7:
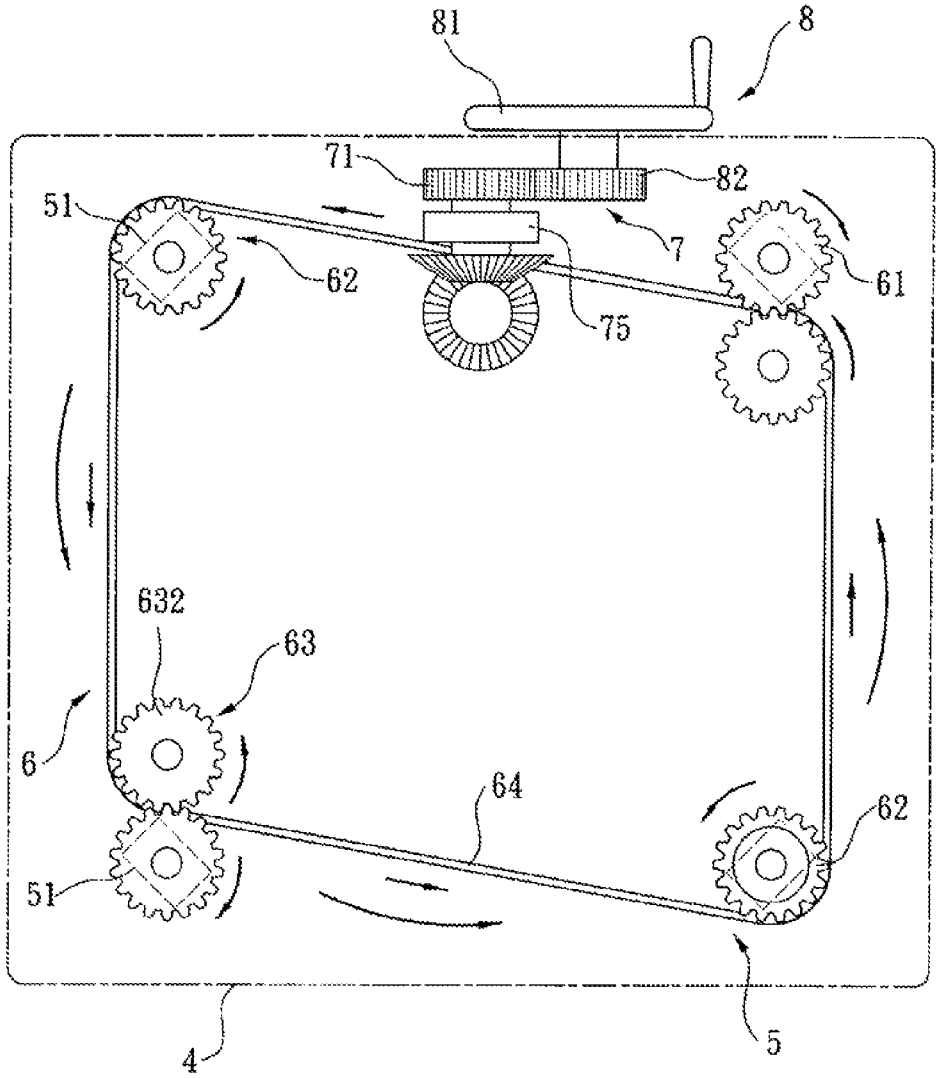
FIG. 7 shows that the operation device drives the transmission unit 7 to rotate the casters.
Figure 8:
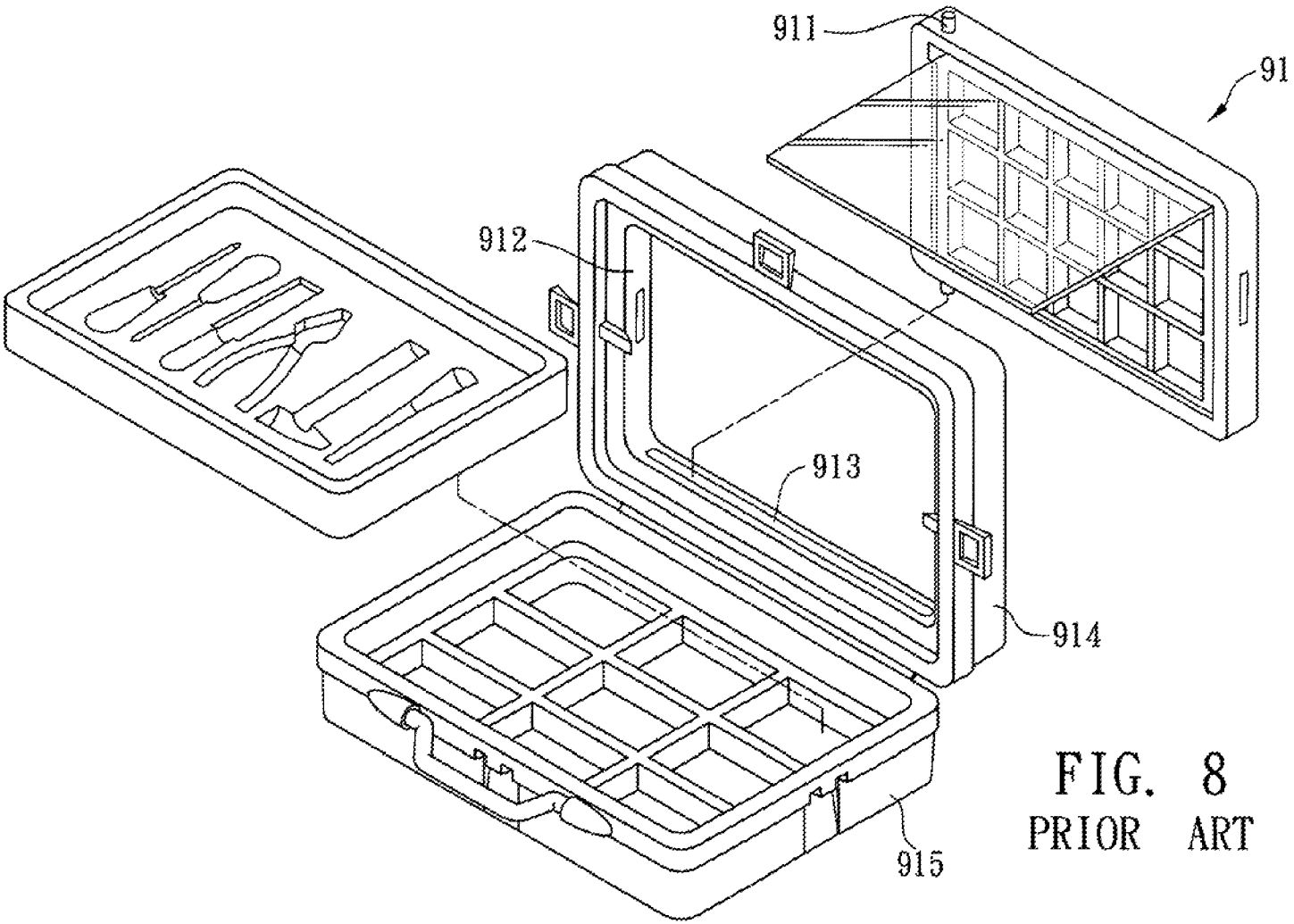
FIG. 8 PRIOR ART
FIG. 8 is an exploded view to show a conventional tool box.
Figure 9:
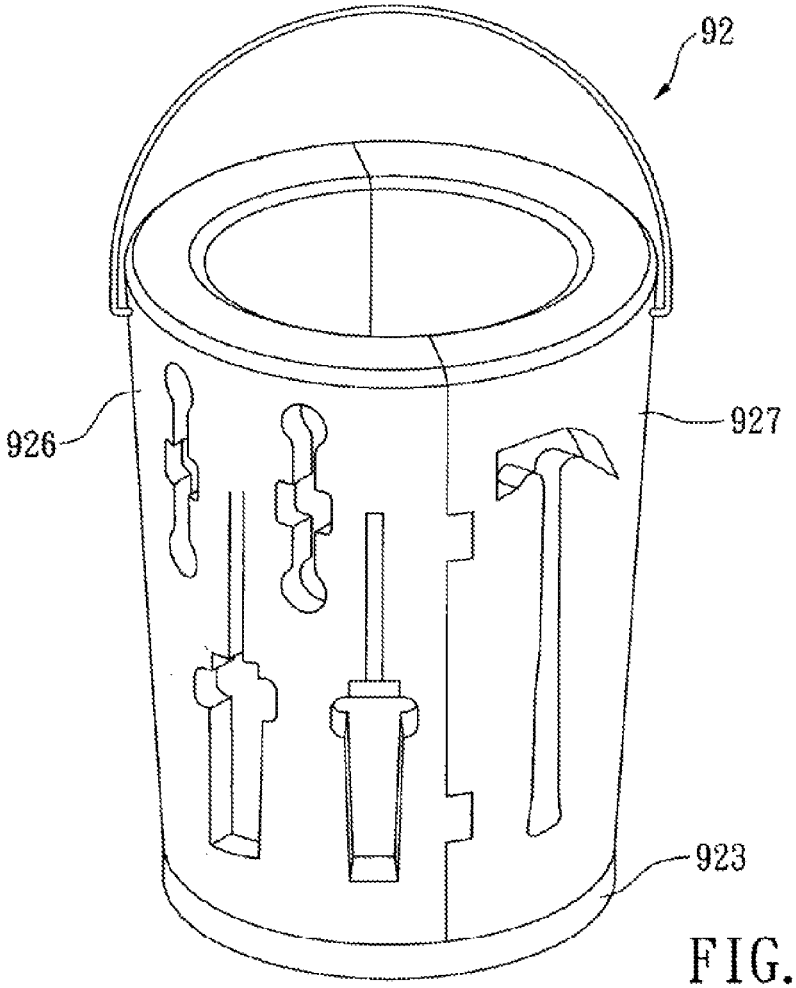
FIG. 9 PRIOR ART
FIG. 9 is a perspective view to show another conventional tool box.
Figure 10:
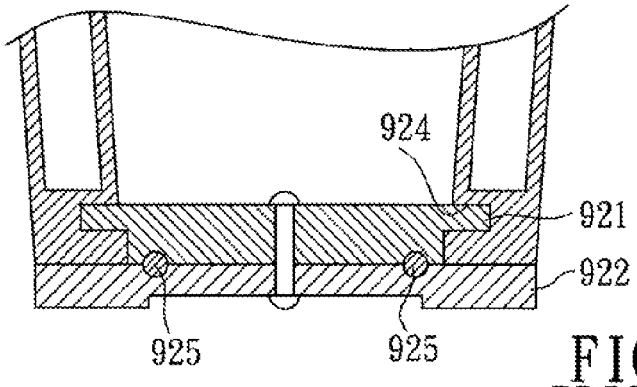
FIG. 10 PRIOR ART
FIG. 10 is a cross sectional view to show the base and the bucket like body of the conventional box in FIG. 9.

Referring to FIGS. 5 to 7, a second embodiment of the tool box of the present invention comprises a body 4 with three drawers 41 received therein and an operation system 5 is connected to the body 4, wherein the operation system 5 includes two first casters 51 and two second casters 51 connected to four corners of an underside of the body 4. The two first casters 51 are located on two ends of a first diagonal line of the body 4 and the two second casters 51 located on two ends of a second diagonal line of the body 4. Each first caster 51 is connected with a first passive gear 61 in an inner space of the body 4 and each second caster 51 is connected with a second passive gear 62 in the inner space of the body 4.

A turning unit 6 includes two dual gear units 63 and each dual gear unit 63 includes a mediate gear 631 and a first idle gear 632 which is connected to the mediate gear 631 by a common shaft. A first belt 64 is engaged between the two respective mediate gears 631 and the two second passive gears. 62. The two respective idle gears 632 are engaged with the two first passive gears 61. A first driving gear 65 driving the first belt 64 and a first bevel gear 66 is connected to the first driving gear 65 by a common shaft.

A transmission unit 7 is located between an operation device 8 and the turning unit 6. The transmission unit 7 includes a second driving gear 71 which is driven by the operation device 8, A first pulley 72 is connected to the second driving gear 71 by a common shaft, and a second bevel gear 74 is engaged with the first bevel gear 66 and is connected with a second pulley 73 by a common shaft. A second belt 75 is connected between the first and second pulleys 72, 73.

The operation device 8 includes an operation wheel 81 located outside of the body 4 and an operation gear 82 which is rotated by the operation wheel 81. The operation wheel 81 and the operation gear 82 are movable to engage with or disengage from the second driving gear 71.

The user can move the operation wheel 81 to adjust the position of the operation gear 82 so as to drive the transmission unit 7 and the turning unit 6 to change the directions of the casters 51.

The present invention provides two embodiments of the tool box and the user can use feet or hands to change the orientation of the tool box. The manual operation can also be replaced by electrical operation or mechanical operation without difficulties.

While we have shown and described the embodiment in accordance with the present invention, it should be clear to those skilled in the art that further embodiments may be made without departing from the scope of the present invention.

What is claimed is:

1. A tool box comprising:

a body;

an operation system including two first casters and two second casters connected to four corners of an underside of the body, the two first casters located on two ends of a first diagonal line of the body and the two second casters located on two ends of a second diagonal line of the body, each first caster connected with a first passive gear and each second caster connected with a second passive gear;

a turning unit including two dual gear units and each dual gear unit including a mediate gear and a first idle gear which is connected to the mediate gear by a common shaft, a first belt engaged between the two respective mediate gears and the two second passive gears, the two respective idle gears engaged with the two first passive gears, a first driving gear driving the first belt; and an operation device driving the first driving gear.

2. The tool box of claim 1, wherein a first bevel gear is connected to the first driving gear by a common shaft and a transmission unit is located between the operation device and the turning unit, the transmission unit includes a second bevel gear which is engaged with the first bevel gear, the operation device driving the second bevel gear.

3. The tool box of claim 2, wherein the transmission unit includes a second driving gear which is driven by the operation device, a first pulley is connected to the second driving gear by a common shaft, the second bevel gear is connected with a second pulley by a common shaft, a second belt is connected between the first and second pulleys.

4. The tool box of claim 3, wherein the operation device includes an operation wheel and an operation gear which is rotated by the operation wheel which is located outside of the body, the operation wheel and the operation gear are movable to engage with or disengage from the second driving gear.

* * * * *